US006920988B1

(12) United States Patent
Ratliff

(10) Patent No.: US 6,920,988 B1
(45) Date of Patent: Jul. 26, 2005

(54) TOWEL BAR, RING OR HOOK ANCHORING DEVICE AND WET TOWEL SHIELD

(76) Inventor: Calvin A. Ratliff, 45 Jennifer Dr., Glen Carbon, IL (US) 62034

( * ) Notice: Subject to any disclaimer, the term of this patent is extended or adjusted under 35 U.S.C. 154(b) by 0 days.

(21) Appl. No.: 10/353,485

(22) Filed: Jan. 29, 2003

(51) Int. Cl.[7] ..... A47F 5/00

(52) U.S. Cl. ..... 211/87.01; 211/105.1; D6/546; D6/549

(58) Field of Search ..... 211/87.01, 88.04, 211/90.01, 105.1; 248/222.1; D8/350; D6/546, D6/547, 548, 549, 550

(56) References Cited

U.S. PATENT DOCUMENTS

| | | | | | |
|---|---|---|---|---|---|
| 1,271,166 | A | * | 7/1918 | Raab | 454/20 |
| 1,404,240 | A | * | 1/1922 | Shupe | 211/6 |
| 1,426,495 | A | * | 8/1922 | Norman | 248/316.7 |
| D71,859 | S | * | 1/1927 | Arnett et al. | D6/563 |
| 2,576,873 | A | * | 11/1951 | Zelov | 211/88.04 |
| 2,664,208 | A | * | 12/1953 | Goodman | 211/88.04 |
| 2,690,152 | A | * | 9/1954 | Riccio | 114/190 |
| 2,915,191 | A | * | 12/1959 | Haines | 211/16 |
| 3,102,636 | A | * | 9/1963 | Boone | 211/45 |
| 3,606,018 | A | * | 9/1971 | Ruina | 211/1.3 |
| 4,361,368 | A | | 11/1982 | Daniels | 312/138 R |
| 4,398,639 | A | | 8/1983 | Daniels | 211/105.1 |
| 4,566,662 | A | * | 1/1986 | Toshishige | 248/222.14 |
| 4,648,189 | A | * | 3/1987 | Michel | 40/546 |
| D291,753 | S | | 9/1987 | Pool | D6/522 |
| 4,702,381 | A | | 10/1987 | Carter et al. | 211/105.2 |
| RE32,616 | E | * | 3/1988 | Graham | 219/385 |
| 4,849,610 | A | | 7/1989 | Alvarez | 219/521 |
| 4,907,771 | A | * | 3/1990 | Wang | 248/222.14 |
| D320,720 | S | | 10/1991 | Goodman et al. | D6/569 |
| D340,377 | S | | 10/1993 | Brazis | D6/549 |
| 5,305,897 | A | * | 4/1994 | Smith | 211/85.7 |
| 5,312,179 | A | | 5/1994 | Schlaud et al. | 312/242 |
| D369,500 | S | | 5/1996 | Hansen, II | D6/523 |
| 5,656,043 | A | * | 8/1997 | Dobbeling | 48/197 R |
| 5,740,926 | A | * | 4/1998 | Mulloy | 211/43 |
| D394,969 | S | * | 6/1998 | Ho | D6/546 |
| 5,775,401 | A | * | 7/1998 | Faurie | 160/349.2 |
| 5,813,550 | A | * | 9/1998 | Sheehan et al. | 211/87.01 |
| 6,024,231 | A | | 2/2000 | Bates | 211/105.1 |
| D423,853 | S | | 5/2000 | Green | D6/549 |
| 6,153,862 | A | | 11/2000 | Job | 219/521 |
| 6,220,460 | B1 | * | 4/2001 | Pan | 211/87.01 |
| D441,582 | S | * | 5/2001 | Moore | D6/546 |
| 6,273,272 | B1 | * | 8/2001 | Hake | 211/4 |
| D450,508 | S | * | 11/2001 | Simonsen | D6/546 |

* cited by examiner

*Primary Examiner*—Robert W. Gibson, Jr.
(74) *Attorney, Agent, or Firm*—Grace J. Fishel

(57) ABSTRACT

A device for anchoring a towel bar, ring or hook to a supporting surface and for shielding the supporting surface from wet towel damage. The device includes a plate upon which the towel bar, ring or hook is mounted such that the plate extends a distance equal to or longer than one-half of a towel length below the towel bar, ring or hook. Fasteners are provided for attaching the towel bar, ring or hook to the plate and the plate to the supporting surface.

10 Claims, 1 Drawing Sheet

TOWEL BAR, RING OR HOOK ANCHORING DEVICE AND WET TOWEL SHIELD

BACKGROUND OF THE INVENTION

1. Field of the Invention

The present invention relates to device for anchoring a towel bar, ring or hook to a supporting surface and for shielding the supporting surface from wet towel damage.

2. Brief Description of the Prior Art

It is a common problem in household bathrooms and kitchens that the wall behind a towel bar, ring or hook is damaged by wet towels and wet hands reaching for the towels. Most walls are paneled with drywall. Drywall consists of a core of plaster of Paris sandwiched between sheets of paper. The strength of the wall comes from the paper. If the paper is wetted and the core exposed to moisture, the towel bar, ring or hook may pull out of the wall and the damaged section of drywall must be replaced. Even if the towel bar, ring or hook does not pull out of the wall or if the supporting surface is made from wood, the varnished, painted or wallpapered wall behind the towel bar, ring or hook may be damaged by wet towels and hands and need to be redecorated.

Patching drywall is beyond the skills of most home owners as it requires cutting out the damaged section of the wall and replacing the removed drywall with a patch. The edges around the patch must be taped and joint compound applied. After the joint compound dries, the joints must be leveled either by sanding or by washing with a wet sponge to remove excess material. It is very difficult to make the wall smooth. Painting and wallpapering are somewhat easier but most home owners are short of time, given modern day job and family demands, and unnecessary repairs are to be avoided.

BRIEF SUMMARY OF THE INVENTION

In view of the above, it is an object of the present invention to provide a towel bar, ring or hook anchoring device. It is another object to provide a shield to prevent moisture damage to the wall behind a towel bar, ring or hook from wet towels and wet hands reaching for the towel. It is also an object to provide a device that satisfies the previous objects and which is also decorative and durable. Other objects and features of the invention will be in part apparent and in part pointed out hereinafter.

In accordance with the invention, a device for anchoring a towel bar, ring or hook and for protecting a supporting surface from wet towel damage has a plate which is longer than one-half a towel length. The plate has a moisture resistant front face and a flat rear face for attachment to a supporting surface. A towel bar, ring or hook for a towel is mounted on the plate. Means are provided for attaching the towel bar, ring or hook to the plate. A plurality of other means are provided for attaching the plate to a supporting surface.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which.

DETAILED DESCRIPTION OF THE INVENTION

Figure 2:
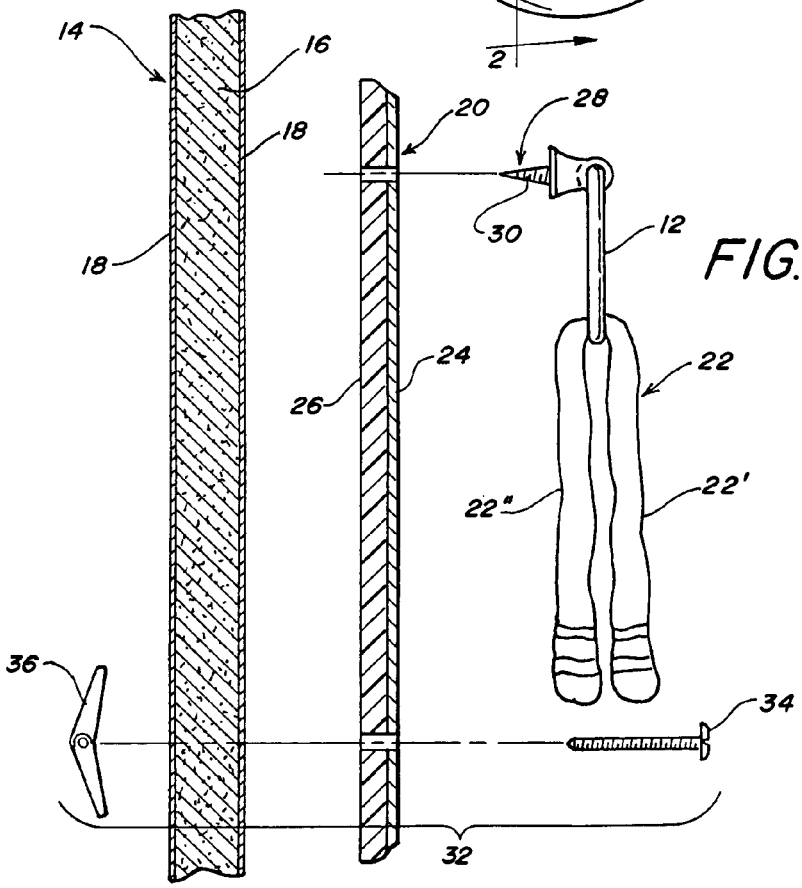

Referring to the drawings more particularly by reference character, reference number 10 refers to a device for anchoring a towel bar, ring or hook 12 and for protecting a supporting surface 14 from wet towel damage in accordance with the present invention. As shown in FIG. 2, supporting surface 14 is a sheet of drywall consisting of a plaster of Paris core 16 sandwiched between sheets of paper 18. In usual manner, drywall 14 is attached to spaced apart studs (not shown) with nails or screws (not shown).

Device 10 includes a plate 20 on which towel bar, ring or hook 12 is mounted. Ideally a towel 22 is folded over or looped over towel bar, ring or hook 12 such that respective portions 22' and 22" hang substantially equally front and back. Below towel bar, ring or hook 12, plate 20 is equal to or slightly longer than one-half a towel length or possibly even longer but with decreasing commensurate benefit obtained from longer length. Plate 20 has a moisture resistant front face 24 and a flat rear face 26 for attachment to supporting surface 14.

Figure 1:
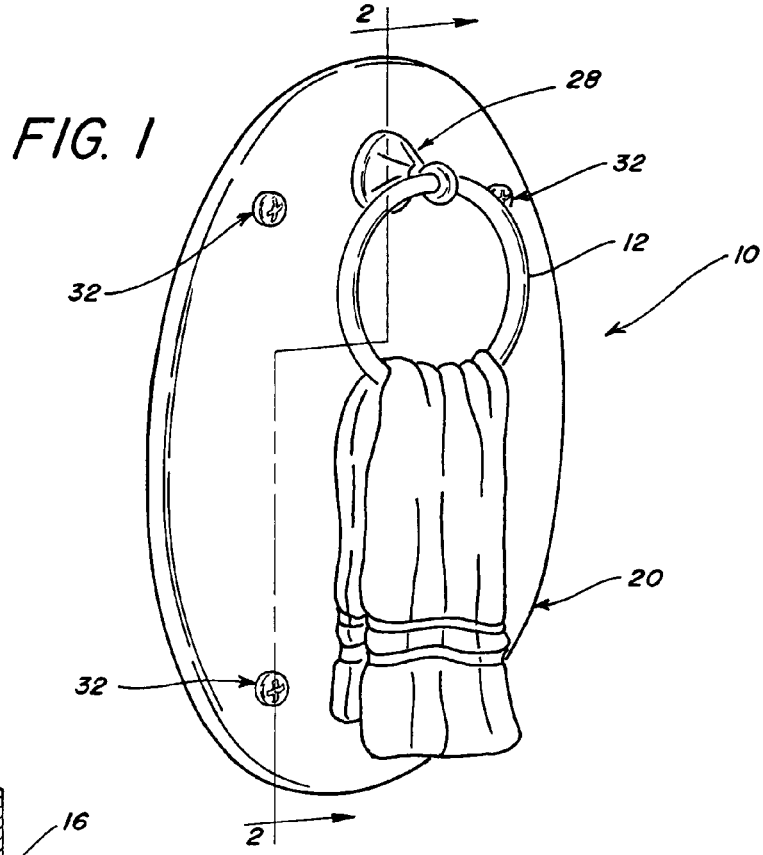
FIG. 1 is a perspective view of a device in accordance with the present invention for anchoring a towel ring to a supporting surface and for shielding the supporting surface from wet towel damage; and, FIG. 2 is an exploded sectional view taken along plane 2—2 in FIG. 1 showing means for attaching a towel hook to a plate and means for attaching the plate to the supporting surface.

Plate 20 may be formed of wood, metal or plastic. It may also be a composite of a plastic laminate such as FORMICA forming front face 24 underlaid by wood forming rear face 26. Plate 20 may be oval as shown in FIG. 1, rectangular, fan shaped or any other desired regular or irregular geometric shape. The periphery of plate 20 may be beveled, scalloped or given some other edge treatment. Hence plate 20 is decorative and can be provided in many styles and colors.

Means 28 for mounting towel bar, ring or hook 12 may be a threaded member 30 as shown in FIG. 2. Threaded member 30 may be an integral part of ring or hook 12 or may be provided separately as screws or the like.

Means 32 for attaching plate 20 to supporting surface 14 may be drywall screws, wall anchors, adhesive or the like. As shown in FIG. 2, means 32 takes the form of a toggle bolt with a round headed bolt 34 and a wing 36 that springs apart for a firm hold in hollow-type drywalls 14 after insertion in a predrilled hole. Other suitable means 32 include expanding anchors and plastic anchors as will occur to one skilled in the art. Adhesives, which would otherwise be unsuitable for mounting towel bar, ring or hook 12, may be used as means 32 because of the expanded surface-to-surface contact between rear face 26 of plate 20 and supporting surface 14. When means 32 are drywall screws or wall anchors, they are preferably provided at spaced intervals about the outer margin of plate 20. When mounted properly, means 32 for attaching plate 20 are capable of withstanding a downward force on towel bar, ring or hook 12 of up to 200 pounds.

Device 10 when constructed as described above weighs less than about 1-½ pounds and is easy to install. In use, towel bar, ring or hook 12 is attached to plate 20 with means 28 for mounting the towel bar, ring or hook to the plate and is preferably supplied to the end user in assembled form. The end user then attaches plate 20 to supporting surface 14 with means 32 for attaching the plate to the supporting surface. Means 32 may be supplied with towel bar, ring or hook 12 mounted on plate 20 or sold separately.

When installed as described above, device 10 provides the following benefits:

1) Prevents drywall 14 from becoming wet or stained with moisture;
2) Creates a shield of protection between towels 22 and supporting surface 14, protecting painted or wallpapered walls or the finish of wood cabinets on which the device may be hung.
3) Can be customized to suit individual needs and tastes.
4) Is durable, practical, functional and provides a distinctive accent to walls.
5) Can support up to 200 pounds such that if towel bar, ring or hook 12 is grabbed as a handrail, it may not be ripped from the wall.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A device for anchoring a means for supporting a bath towel folded over and for protecting a support surface from wet bath towel damage comprising a means for supporting a bath towel folded over;

a plate so dimensioned that it is equal to or longer than one-half a bath towel folded over on the means for supporting a bath towel folded over, said plate having a moisture resistant, plastic covering on a front face and a flat rear face for attachment to a support surface;

means for attaching the means for supporting a bath towel folded over to the plate; and, means for attaching the plate to a supporting surface.

2. The device of claim 1 wherein the means for attaching the means for supporting a bath towel folded over is a threaded member and the means for attaching the plate to a supporting surface are screws, drywall anchors or plastic anchors.

3. The device of claim 1 wherein the front face is decorated.

4. The device of claim 1 wherein the plate is longer than it is wide.

5. A device for anchoring a means for supporting a bath towel folded over and for protecting a support surface from wet bath towel damage comprising a means for supporting a bath towel folded over;

a plate so dimensioned that it is equal to or longer than one-half a bath towel folded over on the means for supporting a bath towel folded over, said plate having a moisture resistant, plastic covering on a front face and a flat rear face for attachment to a support surface;

at least one threaded member for attaching the means for supporting a bath towel folded over to the plate; and, a plurality of screws, drywall anchors or plastic anchors for attaching the plate to a supporting surface.

6. The device of claim 5 wherein the plurality of screws, drywall anchors or plastic anchors are provided at spaced intervals about an outer margin of the plate.

7. The device of claim 6 wherein the plastic covering on the front face of the plate is formed from a plastic laminate and wherein the rear face of the plate is formed of wood.

8. The device of claim 6 wherein the plurality of screws, drywall anchors or plastic anchors is capable of withstanding a downward force of up to 200 pounds on the towel bar, ring or hook.

9. The device of claim 8 weighing less than 1-½ pounds.

10. The device of claim 7 wherein the front face of the plate is decorative.

* * * * *